US011054172B2

(12) United States Patent
Suriya Prakash et al.

(10) Patent No.: US 11,054,172 B2
(45) Date of Patent: Jul. 6, 2021

(54) ENCLOSURE WITH ADJUSTABLE LOUVER PANELS

(71) Applicant: Johnson Controls Technology Company, Auburn Hills, MI (US)

(72) Inventors: Appiya B. Suriya Prakash, Pune (IN); Dnyandev G. Vanare, Dist—Buldhana (IN); Ganesh S. Devkhile, Pune (IN); Anil V. Bhosale, District Satara (IN)

(73) Assignee: Johnson Controls Technology Company, Auburn Hills, MI (US)

( * ) Notice: Subject to any disclaimer, the term of this patent is extended or adjusted under 35 U.S.C. 154(b) by 210 days.

(21) Appl. No.: 16/126,927

(22) Filed: Sep. 10, 2018

(65) Prior Publication Data

US 2020/0064016 A1 Feb. 27, 2020

Related U.S. Application Data

(60) Provisional application No. 62/720,824, filed on Aug. 21, 2018.

(51) Int. Cl.

| | |
|---|---|
| ***F24F 13/15*** | (2006.01) |
| ***F24F 13/14*** | (2006.01) |
| ***F24F 13/20*** | (2006.01) |
| ***F24F 11/70*** | (2018.01) |
| ***F24F 1/58*** | (2011.01) |
| *F24F 110/40* | (2018.01) |
| *F24F 130/10* | (2018.01) |
| *F24F 110/12* | (2018.01) |

(52) U.S. Cl.

CPC ..... *F24F 13/15* (2013.01); *F24F 1/58* (2013.01); *F24F 11/70* (2018.01); *F24F 13/1426* (2013.01); *F24F 13/20* (2013.01); *F24F 2013/144* (2013.01); *F24F 2013/1466* (2013.01); *F24F 2110/12* (2018.01); *F24F 2110/40* (2018.01); *F24F 2130/10* (2018.01)

(58) Field of Classification Search

CPC ..... F24F 1/58; F24F 13/15; F24F 13/1426; F24F 13/20; F24F 11/70; F24F 2130/10; F24F 2110/12; F24F 2110/40; F24F 2013/144; F24F 2013/1466

USPC ..... 454/256

See application file for complete search history.

(56) References Cited

U.S. PATENT DOCUMENTS 3,379,481 A * 4/1968 Fisher ..... F24F 13/20 312/100

4,615,181 A * 10/1986 Greenwood ..... F25B 31/006 62/279

(Continued)

*Primary Examiner* — Kenneth J Hansen
*Assistant Examiner* — Dana K Tighe
(74) *Attorney, Agent, or Firm* — Fletcher Yoder, P.C.

(57) ABSTRACT

A housing system for heating, ventilation, and/or air conditioning (HVAC) equipment includes a housing configured to shroud the HVAC equipment and also includes a plurality of louver panels disposed on the housing. Each louver panel of the plurality of louver panels is configured to translate between a closed position and an open position. In the closed position, each louver panel of the plurality of louver panels is configured to permit airflow between an interior of the housing and an ambient environment. In the open position, each louver panel of the plurality of louver panels is configured to permit increased airflow between the interior of the housing and the ambient environment when the louver panel is in the open position.

17 Claims, 9 Drawing Sheets

(56) References Cited

U.S. PATENT DOCUMENTS

| | | | | |
|---|---|---|---|---|
| 4,953,328 | A * | 9/1990 | Sewell | F24F 1/58 52/473 |
| 5,129,239 | A | 7/1992 | Thurman | |
| 6,401,477 | B1 | 6/2002 | Dubé | |
| 6,430,954 | B1 * | 8/2002 | Smith | F24F 1/58 135/913 |
| 8,357,031 | B2 * | 1/2013 | Dinicolas | F24F 13/20 454/201 |
| 9,291,356 | B2 | 3/2016 | Demster | |
| 2008/0083239 | A1 | 4/2008 | Meyer | |
| 2008/0178624 | A1 | 7/2008 | Zedney | |
| 2013/0005238 | A1 * | 1/2013 | Brandt | F24F 13/14 454/275 |
| 2017/0223874 | A1 * | 8/2017 | Roy | H05K 7/20836 |

* cited by examiner

ENCLOSURE WITH ADJUSTABLE LOUVER PANELS

CROSS REFERENCE TO RELATED APPLICATIONS

This application claims priority from and the benefit of U.S. Provisional Application Ser. No. 62/720,824, entitled "ENCLOSURE WITH ADJUSTABLE LOUVER PANELS," filed Aug. 21, 2018, which is hereby incorporated by reference in its entirety for all purposes.

BACKGROUND

The disclosure relates generally to heating, ventilation, and air conditioning (HVAC) systems, and specifically, to a louver panel system configured to shroud components of the HVAC system.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and/or air conditioning (HVAC) systems are utilized in residential, commercial, and industrial applications to control environmental properties, such as temperature and humidity, for occupants of respective environments. The HVAC system may control the environmental properties through control of an air flow delivered to and ventilated from spaces serviced by the HVAC system. For example, an HVAC system may transfer heat between the air flow and refrigerant flowing through the system. Certain components of the HVAC system may be located in an ambient environment, where they may be subject to external elements and conditions of the ambient environment, such as precipitation. It is now recognized that such conditions may affect performance of the HVAC system.

SUMMARY

In one embodiment, a housing system for heating, ventilation, and air conditioning (HVAC) equipment includes a housing configured to shroud the HVAC equipment and also includes a plurality of louver panels disposed on the housing. Each louver panel of the plurality of louver panels is configured to translate between a closed position and an open position. In the closed position, each louver panel of the plurality of louver panels is configured to permit airflow between an interior of the housing and an ambient environment. In the open position, each louver panel of the plurality of louver panels is configured to permit increased airflow between the interior of the housing and the ambient environment when the louver panel is in the open position.

In another embodiment, a housing for heating, ventilation, and/or air conditioning (HVAC) equipment includes a frame defining an internal volume configured to receive the HVAC equipment and also includes a plurality of louver panels coupled to the frame. Each louver panel of the plurality of louver panels is configured to translate between a closed position and an open position, where each louver panel of the plurality of louver panels is configured to shroud the internal volume in the closed position and expose the internal volume in the open position.

In another embodiment, an enclosure for heating, ventilation, and/or air conditioning (HVAC) equipment includes a housing configured to contain the HVAC equipment within an interior of the housing and also includes a louvered panel system coupled to the housing. The louvered panel system includes a plurality of louvered panels, where each louvered panel includes a plurality of louvers and a plurality of openings disposed between the plurality of louvers. Each louvered panel of the plurality of louvered panels is configured to transition between an open position and a closed position. In the closed position, each louvered panel is configured to permit airflow between the interior of the housing and an ambient environment. In the open position, each louvered panel is configured to permit increased airflow between the interior of the housing and the ambient environment.

DRAWINGS

Various aspects of this disclosure may be better understood upon reading the following detailed description and upon reference to the drawings in which.

DETAILED DESCRIPTION

Figure 1:
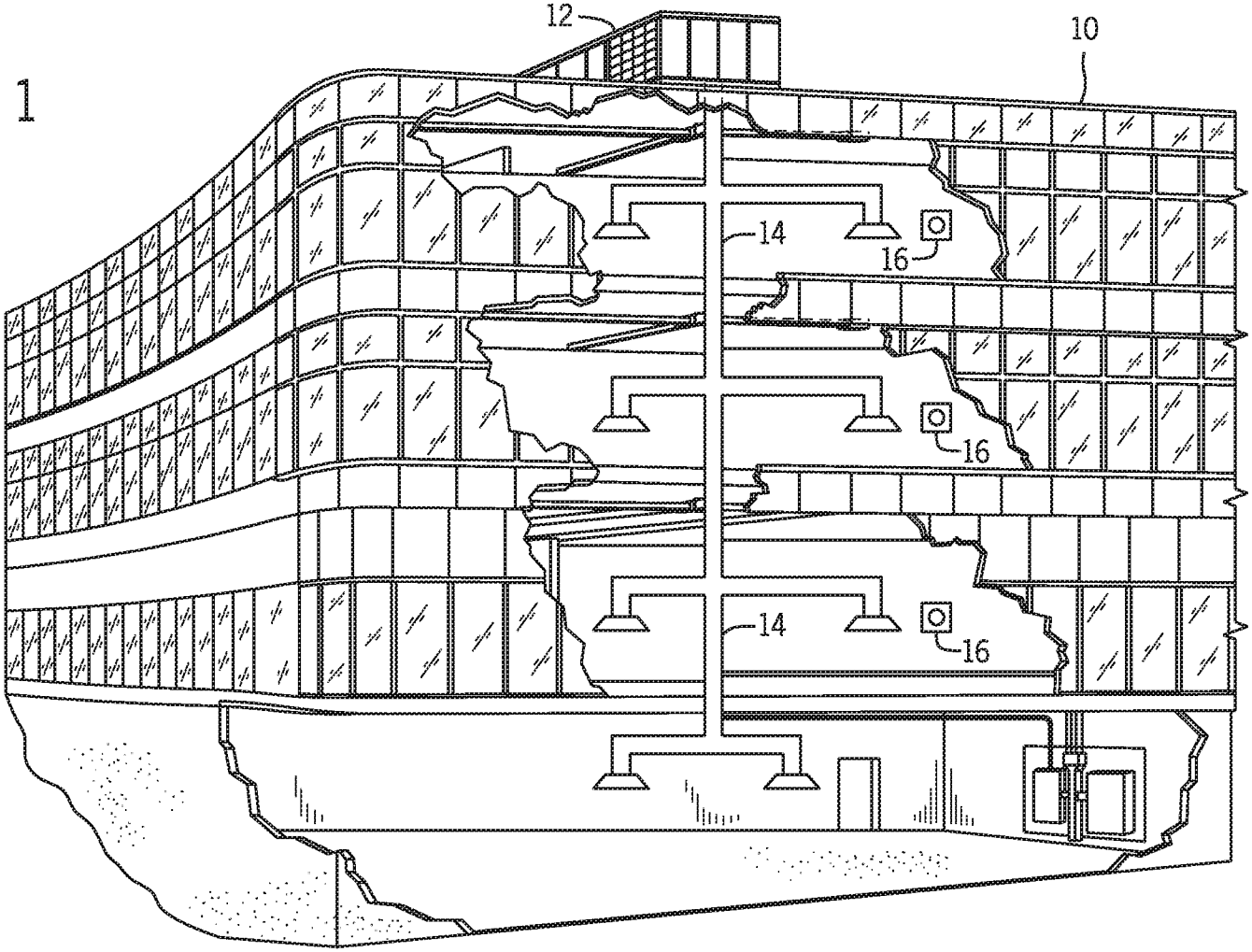
FIG. 1 is a schematic of an embodiment of an environmental control for building environmental management that may employ one or more HVAC units, in accordance with an aspect of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present disclosure is directed to heating, ventilation, and air conditioning (HVAC) systems that include components for facilitating heat transfer between an airflow and a refrigerant. For example, the HVAC system includes heat exchangers configured to add and/or remove heat to the refrigerant, a compressor configured to pressurize the refrigerant, and tubing configured to transfer the refrigerant from one component to another.

Certain components of the HVAC system may be located in an ambient environment and are thus subjected to conditions of the ambient environment. In some instances, the conditions include encountering environmental elements, such as precipitation. An enclosure may be included with the HVAC system to block such external elements from contacting components within the enclosure, thereby protecting the components from the external elements. In some existing systems, the enclosure is fastened together to shroud the components from external elements during operation of the HVAC system, and the enclosure is only opened when access to the components is desired, such as during maintenance. However, during operation of the HVAC system, the enclosure may hinder or inhibit airflow within the HVAC system and/or airflow between the HVAC system and the ambient environment. This may result in undesired heating of the components and/or decreased heat transfer within the HVAC system, which may result in operational inefficiency of the HVAC system.

Thus, in accordance with certain embodiments of the present disclosure, it is presently recognized that an adjustable louver panel system that may be selectively and readily actuated to enable increased airflow between the ambient environment and the HVAC system and thereby enable the HVAC system to operate at an increased efficiency. Specifically, an enclosure or housing of the HVAC system that houses internal HVAC components may include the adjustable louver panel system having adjustable louver panels that may transition between a closed position and an open position. In the closed position, the louver panels may block certain external elements from entering the housing and potentially contacting the internal HVAC components. The adjustable louver panels may also include openings to permit some degree of airflow between the interior of the housing and the external environment in the closed position. In the open position, the internal components of the HVAC system may be exposed to the ambient environment to permit increased airflow into and out of the housing and/or to permit access to internal components within the housing. The adjustable louver panels may be configured to easily transition between the closed position and the open position to enable efficient operation of the adjustable louver panel system. For example, the adjustable louver panels may be actuated manually, automatically, and/or remotely, such as via a controller.

Turning now to the drawings, FIG. 1 illustrates a heating, ventilation, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single packaged unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
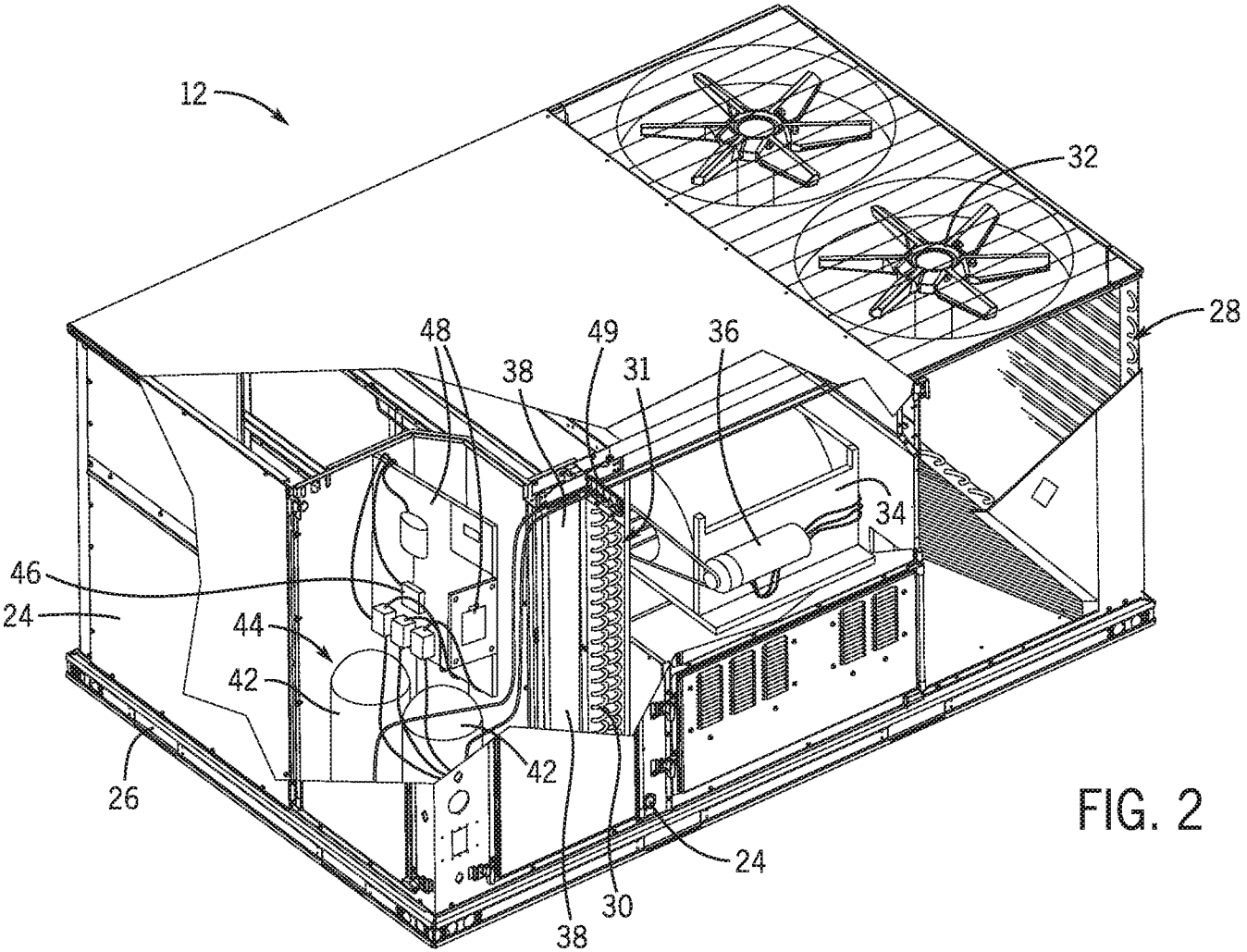
FIG. 2 is a perspective view of an embodiment of an HVAC unit that may be used in the environmental control system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multi-channel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
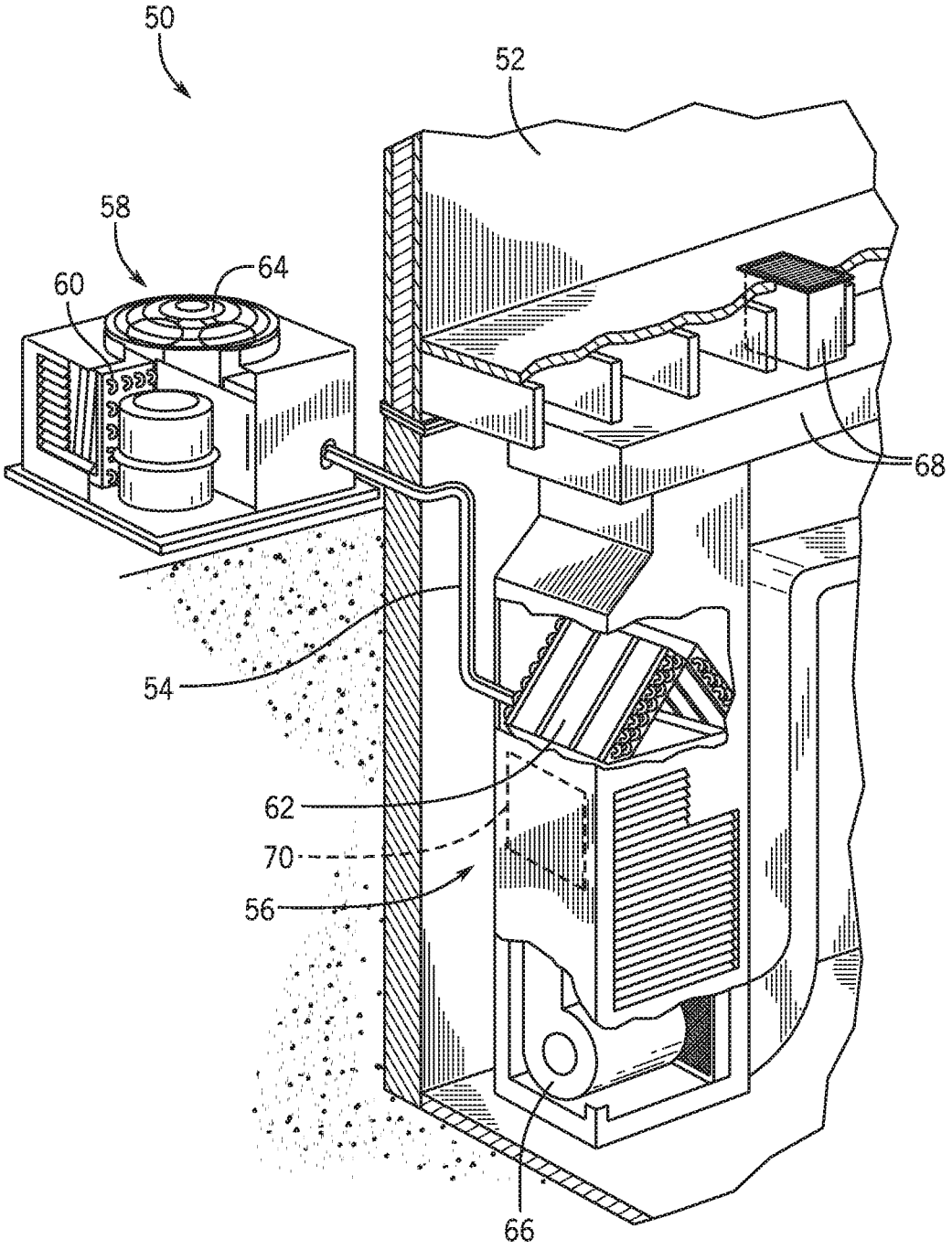
FIG. 3 is a schematic of an embodiment of a residential heating and cooling system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
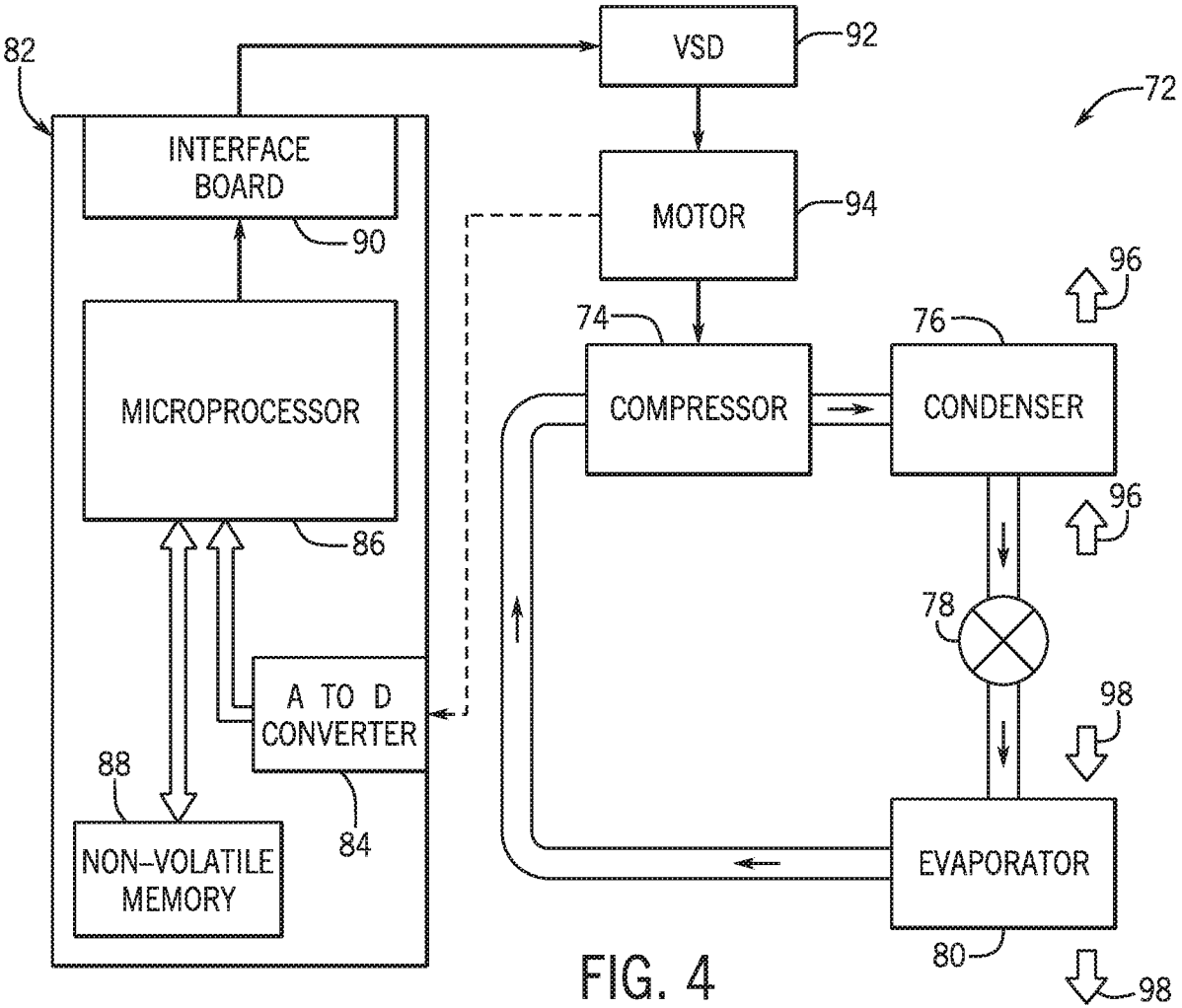
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As noted above, certain components of HVAC systems may be positioned in an ambient environment. For example, as discussed above, the rooftop unit 12 discussed with reference to FIG. 2 is configured to be disposed in an ambient environment. Components of HVAC systems disposed in ambient environments are exposed to conditions and external elements of the ambient environment, including precipitation, wildlife, and/or debris, such as leaves. To block such objects or elements from contacting certain components of the HVAC system or otherwise interfering with HVAC system, the HVAC system may include a housing that surrounds and/or encloses the components. An adjustable louver panel system may be included with the housing, where the adjustable louver panel system includes louver panels configured to shroud the components or otherwise protect the components from external elements in a closed position.

As will be appreciated, a housing enclosing the HVAC components may reduce or inhibit a flow of air between the HVAC components within the housing and the ambient environment, which may reduce operational efficiency of the HVAC system. Accordingly, the louver panels are configured to transition from the closed position to an open position to enable increased flow of air when the desire to shroud the HVAC components is reduced. For example, during weather seasons when hail is typical or anticipated, the louver panels may be in the closed position to protect the HVAC components within the housing. The louver panels may include openings that enable a flow of air across the louver panels and into the housing when the louver panels are in the closed position. However, during other weather seasons when hail is not anticipated, the louver panels may be opened to enable increased airflow into and out of the housing. By enabling increased airflow in the open position, the adjustable louver panel system may reduce heating of the internal HVAC components that may affect performance of the components and/or the adjustable louver panel system may increase volumetric airflow through the internal HVAC components to increase heat transfer between the refrigerant and the airflow. As discussed herein, embodiments of the present disclosure may be utilized in any of the aforementioned HVAC systems. For example, the adjustable louver panel system may be implemented for outdoor packaged units, such as the HVAC unit 12 of FIGS. 1 and 2, or for other components located in an ambient environment, such as the outdoor HVAC unit 58 of the residential heating and cooling system 50 of FIG. 3.

Figure 5:
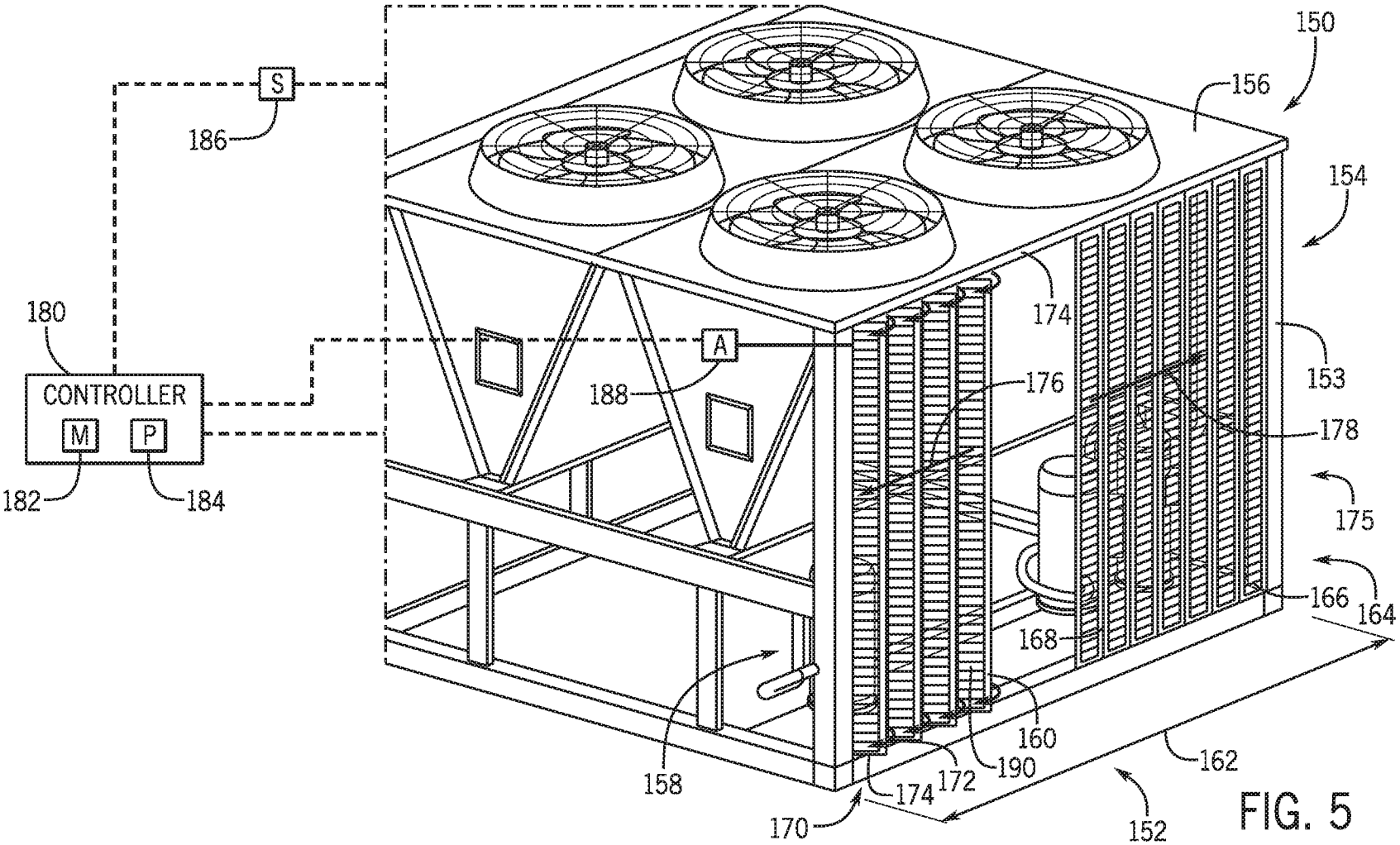
FIG. 5 is a perspective view of an embodiment of an HVAC system that includes an adjustable louver panel system, in accordance with an aspect of the present disclosure.

FIG. 5 illustrates a perspective view an embodiment of an HVAC system 150 that includes an adjustable louver panel system 152 coupled to a frame 153 of the HVAC system 150 on a side 154 of the frame 153. In certain embodiments, the HVAC system 150 includes a housing 156, where the housing 156 and/or the frame 153 define an internal volume of the HVAC system 150 to enclose internal components 158 of the HVAC system 150. For example, the internal components 158 may include a condenser, a compressor, a control panel, refrigerant conduits, and so forth. In some embodiments, the louver panel system 152 may be coupled to the housing 156 or to a combination of the frame 153 and the housing 156. The louver panel system 152 includes louver panels 160 configured to shroud the internal components 158 from an ambient environment and elements of the ambient environment, such as precipitation, debris, wildlife, and other objects. It should be understood that, as used to herein, the louver panels 160 include panels and/or a set of panels that may each include a plurality of louver blades supported by the respective panel. In some embodiments, the louver blades may be fixed to the panel, while in other embodiments the louver blades may be adjustable. The louver panels 160 may also be referred to as louvered panels and thus, the louver panel system 152 may also be referred to as a louvered panel system.

As illustrated in FIG. 5, the louver panels 160 may be aligned in a row across a length 162 of the side 154. The louver panels 160 are adjustable between an open position and a closed position. In the closed position, as shown via a first set 164 of louver panels 160, the louver panels 160 are positioned such that each louver panel 160 covers a portion of the side 154. For example, a face 166 of each louver panel 160 in the first set 164 is substantially parallel to the side 154 to increase a coverage by the louver panel 160. In other words, in the closed position, the louver panel 160 is configured to serve as a barrier between certain elements of the ambient environment and the internal components 158 within the housing 156. Each louver panel 160 may include an interlocking mechanism configured to interlock with adjacent louver panels 160. For example, each louver panel 160 may include a lip section that extends and overlaps with adjacent louver panels 160 to cover a gap or space 168 between adjacent louver panels 160. The lip sections may also include a lock configured to lock with the adjacent louver panel 160 to securely cover the space 168. By covering the space 168, the louver panel system 152 further shrouds and protects the internal components 158 from the ambient environment.

In the open position, as shown by a second set 170 of louver panels 160, the louver panels 160 are each rotated in a direction 172 to expose the internal components 158 to the ambient environment. With the rotation of the louver panels 160, the space 168 between adjacent louver panels 160 increases to permit greater airflow between the interior of the housing 156 and the ambient environment. In other words, in the open position, the louver panels 160 are each positioned crosswise or substantially perpendicular to the side 156 of the HVAC system 150.

To enable rotation, the louver panels 160 may couple to the housing 156 or the frame 153 via hinges, pins, rods, or other mechanical features at coupling points 174 that may be located at opposite ends of each louver panel 160. While the second set 170 of louver panels 160 is configured to rotate between the open and closed positions, the first set 164 of louver panels 160 is configured to linearly translate in a direction 176 and/or a direction 178 along the housing 156 or frame 153. That is, the louver panels 160 of the first set 164 are configured to linearly translate between the open position and/or the closed position. To enable the louver panels 160 to linearly translate, the coupling points 174 of each louver panel 160 may be configured to linearly translate along the length 162 of the side 154. For example, opposite ends of each louver panel 160 may be engaged with slots or rails formed in the housing 156 or frame 153, and the louver panels 160 may slide along the slots or rails to linearly translate to a desired position. In an embodiment where the louver panels 160 are configured to linearly translate, the louver panels 160 may be adjacent to one another in the closed position, thereby creating a shroud or barrier for the HVAC system 150, and the louver panels 160 may slide to overlap with one another at an end 175 of the side 154 of the housing 156 to expose the interior of the HVAC system 150 to the surrounding environment.

In some embodiments, the louver panels 160 may be configured to rotationally and linearly translate between open and closed positions. For example, each louver panel 160 may have a pin disposed at each end of the louver panel 160 that is engaged with a slot or rail of the frame 153 or housing 156. Each louver panel 160 may rotate about the pins to transition between open and closed positions. Additionally, each louver panel 160 may be linearly translated along the slot or rail via the pins to enable abutment or stacking of the louver panels 160 against one another in the opened position, such as at the end 175 of the side 154 of the housing 156.

The position of the louver panels 160, such as the open or closed position, may also be set, fixed, or secured in place until a transition to another position is desired. For example, the adjustable louver panel system 152 may include clamps, fasteners, locks, latches, straps, another suitable component, or any combination thereof, disposed at the coupling points 174 that are configured to secure the position of each louver panel 160 that has rotationally translated in the direction 174 and/or linearly translated in the direction 176 and/or the direction 178.

In certain embodiments, each louver panel 160 is configured to move independently of one another. That is, the louver panels 160 may rotationally translate and/or linearly translate separately from other louver panels 160. As such, when the louver panels 160 are in the open position, the gap or space 168 between two louver panels 160 may vary in size amongst different adjacent louver panels 160. Moreover, the louver panels 160 may be configured to transition between positions such that a number of the louver panels 160 are in the open position and a remainder of the louver panels 160 are in the closed position. Such configurations may shroud certain sections or components of the HVAC system 150 while exposing other sections or components to the ambient environment, such as for maintenance of particular internal components 158.

As mentioned, the closed position of the louver panels 160 enables the louver panels 160 to shroud the internal components 158, but the closed position of the louver panels 160 may also reduce an amount of airflow between the interior of the housing 156 and the ambient environment. Reduced airflow into and out of the housing 156 may decrease operational efficiency of the HVAC system 150. As such, it may be advantageous for the louver panels 160 to remain in the open position for a duration of time when shrouding the internal components 158 is not desired. To control the positioning of the louver panels 160, the HVAC system 150 may include and/or be in communication with a controller 180. The controller 180, which may be similar to the control panel 82, may include a memory 182 and a processor 184. The memory 182 may be a mass storage device, a flash memory device, removable memory, or any other non-transitory computer-readable medium that includes instructions regarding control of the HVAC system 150. The memory 182 may also include volatile memory such as randomly accessible memory (RAM) and/or non-volatile memory such as hard disc memory, flash memory, and/or other suitable memory formats. The processor 184 may execute the instructions stored in the memory 182, such as instructions to adjust the position of the louver panels 160.

In some embodiments, the position of the louver panels 160 is remotely adjustable. That is, a user may input when to position the louver panels 160 and/or how to position the louver panels 160. For example, the user may input which louver panels 160 to rotate, a certain angle at which to rotate the louver panels 160, which louver panels 160 to linearly translate, a length to linearly translate the louver panels 160, another parameter of the louver panels 160, or any combination thereof. In additional or alternative embodiments, the controller 180 may be configured to automatically adjust the positions of the louver panels 160. For example, the controller 180 may be programmed to automatically adjust the louver panels 160 at certain conditions, such as at certain times of the day or year, during certain weather conditions, and so forth. That is, the controller 180 may monitor certain identified conditions or parameters and adjust the louver panels 160 accordingly. By way of example, the HVAC system 150 may be located in a geographic location that includes many diurnal animals and very few nocturnal animals. Thus, the controller 180 may maintain the louver panels 160 in the closed position during the day to block the wildlife from interfering with the internal components 158 and then adjust the louver panels 160 to be in the open position during the night to increase efficiency of the HVAC system 150 via increased airflow into the housing 156.

In a further example, the controller 180 may be configured to monitor weather conditions and adjust the positions of the louver panels 160 based on the weather conditions. As such, the controller 180 may be configured to receive information, such as via sensors, indicative of precipitation, temperature, atmospheric pressure, another weather condition, or any combination thereof. Based on the received information, the controller 180 may determine if adjustments to the position of the louver panels 160 are desirable. To this end, the HVAC system 150 may include sensors 186 configured to detect or measure one or more of the aforementioned conditions and/or other parameters associated with operating conditions for the HVAC system 150. For example, the illustrated embodiment includes sensors 186 disposed outside of the housing 156 to detect conditions of the ambient environment. In additional or alternative embodiments, the controller 180 may be configured to receive user input in order to program the controller 180 to adjust positions of the louver panels 160 in response to certain conditions. In this manner, the controller 180 may adjust positions of the louver panels 160 as determined by a user.

In certain embodiments, the sensors 186 may also be configured to determine positions of the louver panels 160. As an example, the sensors 186 may determine an amount that the louver panels 160 are rotationally translated and/or linearly translated. The controller 180 may determine, based on readings by the sensors 186, an amount of airflow flowing between the interior of the housing 156 and the ambient environment based at least in part on the position readings by the sensors 186. The controller 180 may use such measurements to determine if further positional adjustments of the louver panels 160 are desired based on the determinations of the sensors 186. For example, the louver panels 160 may be adjusted to permit a lower airflow between the HVAC system 150 and the ambient environment at a first time of day, a higher airflow at a second time of day, and an intermediate airflow at a third time of day. Thus, the controller 180 may use the detections of the sensors 186 to determine if the louver panels 160 are positioned as desired at the different times of day.

Additionally, the HVAC system 150 may include actuators 188 configured to facilitate movement of the louver panels 160. For example, the actuators 188 may be positioned on the rails and/or at the coupling points 174 to rotationally translate and/or linearly translate the louver panels 160. The actuators 188 may be electromechanical actuators, hydraulic actuators, pneumatic actuators, thermal actuators, another type of actuator, or any combination thereof. Further, the actuators 188 may be communicatively coupled to the controller 180 such that, when activated, the actuators 188 impart a force and/or torque to linearly translate the louver panels 160 and/or rotationally translate the louver panels 160. It should be appreciated that the detections of the sensors 186 may be used to determine when to activate the actuators 188, such as based on the aforementioned conditions, the position of the louver panels 160, force/torque feedback, another parameter, or any combination thereof.

To enable some degree of airflow between the interior of the HVAC system 150 and the ambient environment while the louver panels 160 are in the closed position, each louver panel 160 includes openings 190. A size of the openings 190 enables airflow while the louver panels 160 still shroud the internal components 158 from the ambient environment. As mentioned, the openings 190 may be created between louver blades, but it should also be appreciated that grilles, perforations, other feature, or any combination thereof may additionally or alternatively be disposed on each louver panel 160 to create the openings 190. In certain embodiments, the size of the openings 190 may be adjustable, such as via adjusting angles or positions of the individual louver blades of the louver panel 160, and the controller 180 may be configured to adjust the size of the openings 190 in a manner similar to adjusting the position of the louver panels 160. However, in other embodiments, the size of the openings 190 may be fixed, such as via fixed positions of the louver blades.

Although FIG. 5 illustrates that each louver panel 160 is of approximately the same shape and size, it should be appreciated that louver panels 160 of other shapes and sizes may also be used to shroud the internal components 158. Furthermore, the louver panel system 152 may be aligned in a different manner than shown in FIG. 5, such as vertically rather than horizontally as indicated in FIG. 5, and/or may include any suitable number of louver panels 160 that may be different than the number of louver panels 160 depicted in FIG. 5. In some embodiments, the louver panels 160 may be adjusted between the open position and the closed position in methods in addition to or alternative to rotational and/or linear translations.

Figure 6:
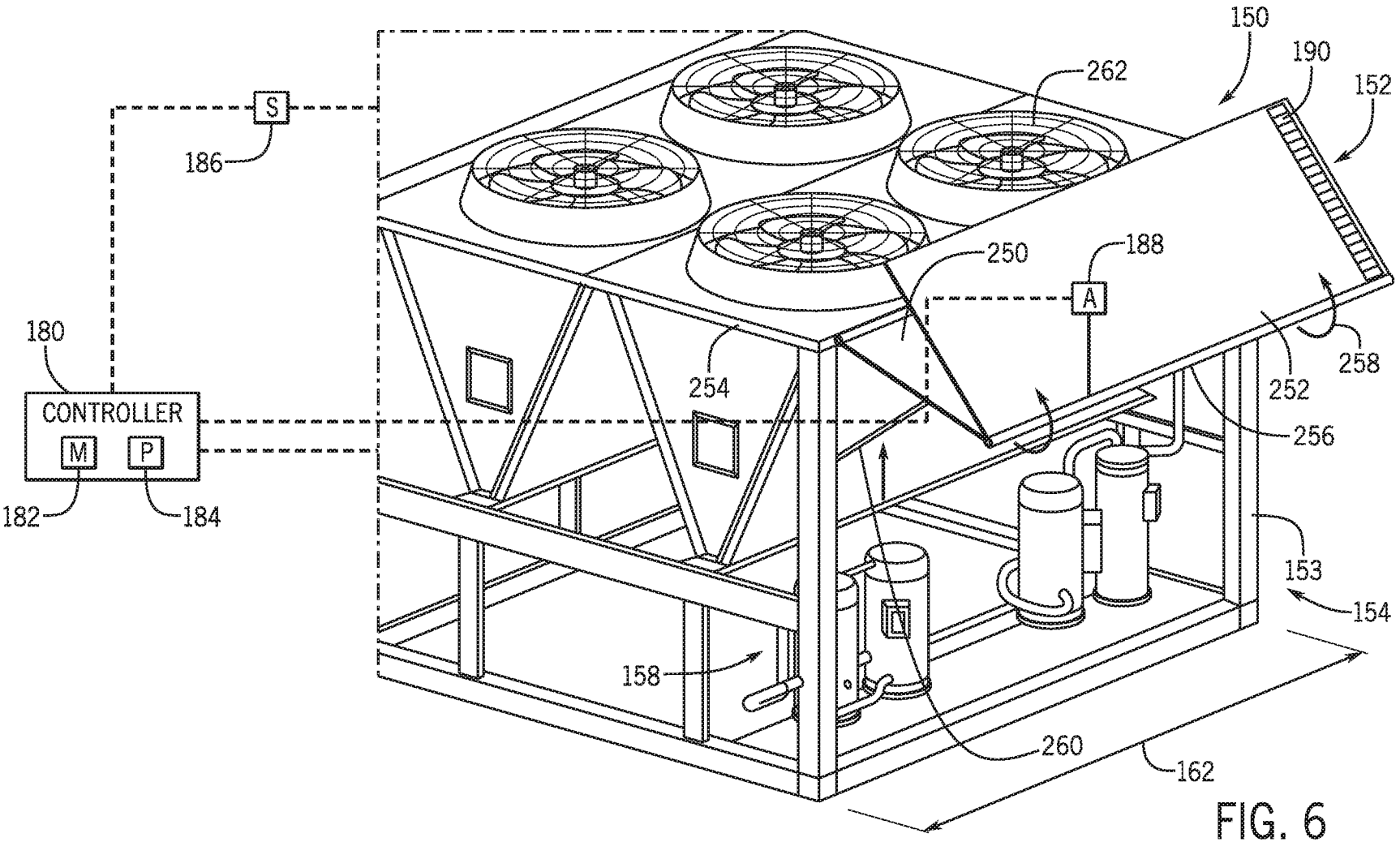
FIG. 6 is a perspective view of another embodiment of an HVAC system that includes an adjustable folding louver panel system, in accordance with an aspect of the present disclosure.

Another embodiment of the louver panel system 152 is illustrated in FIG. 6, which is a perspective view of another embodiment of the HVAC system 150. The illustrated embodiment of the louver panel system 152 is also coupled to the side 154. The louver panel system 152 includes a first louver panel 250 and a second louver panel 252 that are coupled to one another. As shown in FIG. 6, the first louver panel 250 is coupled to a top 254 of the housing 156 and/or frame 153 on the side 154 of the HVAC system 150, and the second louver panel 252 is coupled to an end 256 of the first louver panel 250. In some embodiments, the first louver panel 250 is coupled to the top 254 via a rotational joint, and the second louver panel 252 is coupled to the first louver panel 250 via another rotational joint. In this manner, the first louver panel 250 is configured to pivot about the top 254, and the second louver panel 252 is configured to pivot about the first louver panel 250. As such, the first louver panel 250 and/or the second louver panel 252 are configured to cooperatively rotate in a direction 258.

The louver panel system 152 of FIG. 6 is configured to transition between a closed position and an open position via rotational translation. In the closed position, the first louver panel 250 and the second louver panel 252 are rotated such that the louver panel system 152 covers a substantial portion of the side 154 to shroud the internal components 158. That is, in the closed position, the first and second louver panels 250 and 252 may be aligned with one another and generally vertically against the frame 153 on the side 154 of the HVAC system 150 to block external elements in the ambient environment from entering the HVAC system 150. In some embodiments, the first and second louver panels 250 and 252 may cover or shroud the entire side 154 in the closed position. Openings 190 may be disposed on the first louver panel 250 and/or the second louver panel 252 to enable some degree of airflow between the HVAC system 150 and the ambient environment. Although FIG. 6 illustrates openings 190 formed in a portion of the second louver panel 252, it should be appreciated that the openings 190 may be formed in any or all portions of the first and second louver panels 250 and 252 to enable airflow between the HVAC system 150 and the ambient environment.

The first louver panel 250 and/or the second louver panel 252 may be rotated to expose the internal components 158 to the ambient environment. The first louver panel 250 and/or the second louver panel 252 may be rotated to a position that opens the side 154 without the louver panel system 152 blocking condenser coils 262 of the HVAC system 150. For example, the second louver panel 252 may be rotated about the first louver panel 250 in the direction 258 to abut and/or stack against the first louver panel 250 such that the louver panel system 152 is in an intermediate position. In this manner, a portion of the internal volume and the internal components 158 of the HVAC system 150 may be exposed. Further, the first louver panel 250 may be rotated about the frame 153 in the direction 258. Rotation of the first louver panel 250 in the direction 258 while the second louver panel 252 rests atop the first louver panel 250 may configure the louver panel system 152 to be an open position, where a greater portion of the internal volume and the internal components 258 of the HVAC system 150 is exposed relative to when the louver panel system 152 is in the intermediate position. The positions of the first louver panel 250 and/or the second louver panel 252 may also be set, such as with any of the aforementioned methods, via components disposed at the hinges on the top 254 and/or the end 256. Additionally, in certain embodiments, the HVAC system 150 may include a brace 260 coupled to the frame 153, where the brace 260 is configured to maintain a position, such as the open position described above, of the first louver panel 250 and/or the second louver panel 252. The brace 260 may be coupled to the frame 153 and may be configured to abut the first louver panel 250 to maintain the open position of the louver panel system 152. It should be appreciated that multiple braces 260 may be used to maintain a desired position of the louver panel system 152.

As with the louver panel system 152 of FIG. 5, the position of the louver panels 250 and 252 of the louver panel system 152 in FIG. 6 may be adjusted via the controller 180. That is, the controller 180 may be configured to rotate the first louver panel 250 and/or the second louver panel 252 to adjust the louver panel system 152 between the open position and the closed position. As such, the louver panel system 152 may include actuators 188 coupled to the top 254, the end 256, or other portion of the HVAC system 150 to enable actuation of the first and second louver panels 250 and 252. The controller 180 may be configured to rotate the louver panels in similar manners and using similar methods to those described in FIG. 5, such as via the use of the sensors 186 and the actuators 188.

Figure 7:
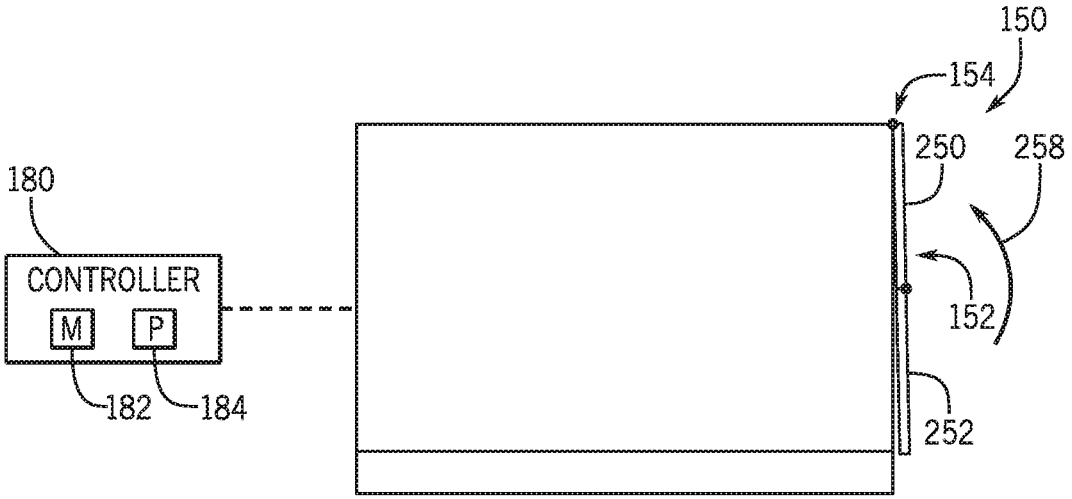
FIG. 7 is a side view schematic of an embodiment of the HVAC system of FIG. 6 with the adjustable folding louver panel system in a first position, in accordance with an aspect of the present disclosure.

To illustrate the adjustable louver panel system 152 in the closed position, FIG. 7 is a side view schematic of the embodiment of the HVAC system 150 of FIG. 6 with the louver panel system 152 positioned to shroud the internal components 158. As shown in FIG. 7, the first louver panel 250 and the second louver panel 252 are positioned such that the louver panel system 152 covers a substantial portion of the side 154. To cover as much of the side 154 as possible, the first louver panel 250 and the second louver panel 252 may be substantially vertically aligned with one another against the side 154. Additionally, a lip may extend between the first louver panel 250 and/or the second louver panel 252, between the first louver panel 250 and a perimeter of the side 154, between the second louver panel 252 and the perimeter of the side 154, or any combination thereof to block spaces between the louver panels 250 and 252 and the HVAC system 150. In some embodiments, edges of the louver panels 250 and 252 may overlap with the frame 153 of the HVAC system 150 when the adjustable louver panel system 152 is in the closed position in order to reduce or eliminate gaps between the frame 153 and the adjustable louver panel system 152. The position of the first louver panel 250 and/or the second louver panel 252 may be secured or maintained relative to the side 154, such as around a portion of the border of the side 154, to further secure the louver panel system 152 onto the HVAC system 150 in the closed position depicted in FIG. 7.

Figure 8:
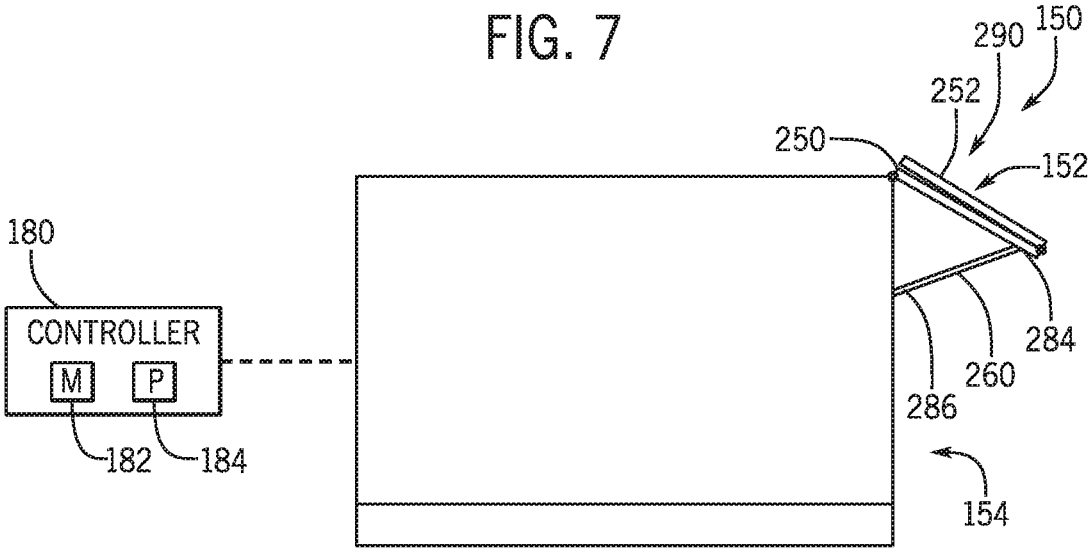
FIG. 8 is a side view schematic of an embodiment of the HVAC system of FIG. 6 with the adjustable folding louver panel system in a second position, in accordance with an aspect of the present disclosure.

To illustrate the adjustable louver assembly 152 in the open position, FIG. 8 is a side view schematic of the embodiment of the HVAC system 150 of FIGS. 6 and 7, with the first louver panel 250 and the second louver panel 252 rotated to expose the internal components 158 to the ambient environment. As shown in FIG. 8, the second louver panel 252 may be rotated such that the second louver panel 252 abuts and rests atop the first louver panel 250. Additionally, the first louver panel 250 may be rotated in the direction 258 to further expose the internal components 158 to the ambient environment. The HVAC system 150 may include the brace 260 described above, which is configured to further secure the position of the louver panel system 152. For example, a first end 284 of the brace 260 is configured to abut against the first louver panel 250 to prop up the first louver panel 250 and the second louver panel 252 resting on the first louver panel 252 to block the adjustable louver panel system 152 from rotating to the closed position. In certain embodiments, a second end 286 of the brace 260 may be pivotally coupled to the frame 153. Thus, in the open position, the brace 260 may be adjusted and positioned to abut against the first louver panel 250. In some embodiments, the brace 260 may be adjusted manually, such as by a user, to abut the first louver panel 250. In additional or alternative embodiments, the brace 260 may be automatically adjusted, such as via the controller 180, to abut the first louver panel 250 when the louver panel system 152 is in the open position. To this end, the controller 180 may determine when the first louver panel 250 is rotated in the direction 258 to expose the internal components 158 and in response, the brace 260 is adjusted to abut the first louver panel 250. It should be appreciated that when the louver panel system 152 is in the open position, the louver panel system 152 may still partially shroud the internal components 158 from certain external elements of the ambient environment by blocking elements traveling in a direction 290 towards the HVAC system 150, such as precipitation.

Figure 9:
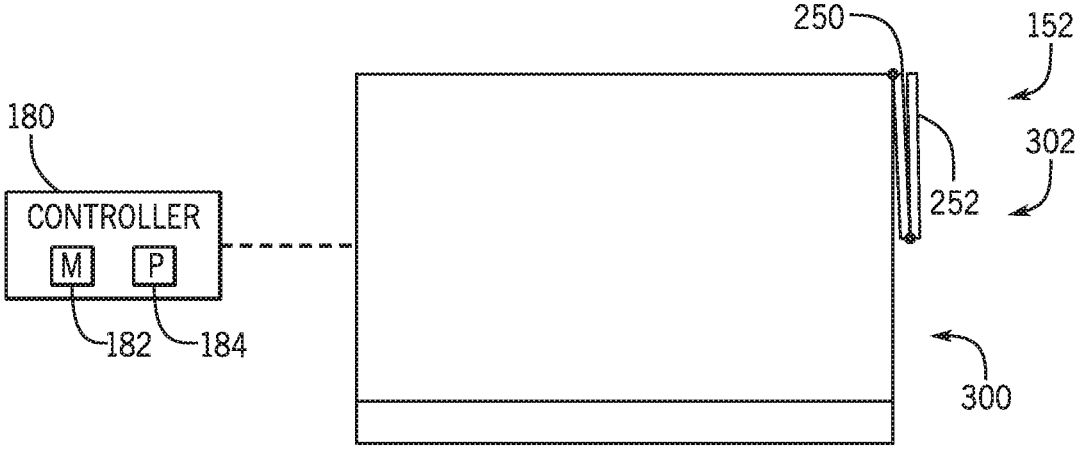
FIG. 9 is a side view schematic of an embodiment of the HVAC system of FIG. 6 with the adjustable folding louver panel system in a third position, in accordance with an aspect of the present disclosure.

The embodiment of the HVAC system 150 of FIGS. 6-8 may also be configured to be positioned in an intermediate position, as illustrated in FIG. 9, which is another side view schematic of the embodiment of the HVAC system 150 of FIGS. 6-8. As shown in FIG. 9, the second louver panel 252 is rotated to overlap with and abut against the first louver panel 250. In this manner, a bottom portion 300 of the side 154 is exposed to the external environment, while a remaining portion 302 of the side 154 is shrouded by the louver panel system 152. The intermediate position may be advantageous in providing partial access to a portion of the internal components 158, such as during a brief maintenance and/or examination, while still shrouding other portions of the internal components 158. To further maintain the intermediate position of the louver panel system 152, locks, latches, hooks, or other retention mechanism may be disposed on the frame 153, first louver panel 250, and/or the second louver panel 252 to couple the two sections with one another in the configuration shown in FIG. 9.

It should be appreciated that the first louver panel 250 and/or the second louver panel 252 may be of a different shape than illustrated in FIGS. 6-9. Additionally, although two louver panels are depicted in the illustrated embodiments discussed, there may be any number of suitable louver panels included in the louver panel system 152, and the louver panels may be of any suitable shape. A rotational joint may couple any of the adjacent louver panels together to permit the louver panels to rotate relative to one another. Furthermore, the louver panels may be of different shapes relative to one another, of different sizes relative to one another, and may attach to the frame 153 or housing 156 in another method, such that translation of the adjustable louver panel system 152 between the open position and the closed position is performed differently.

Figure 10:
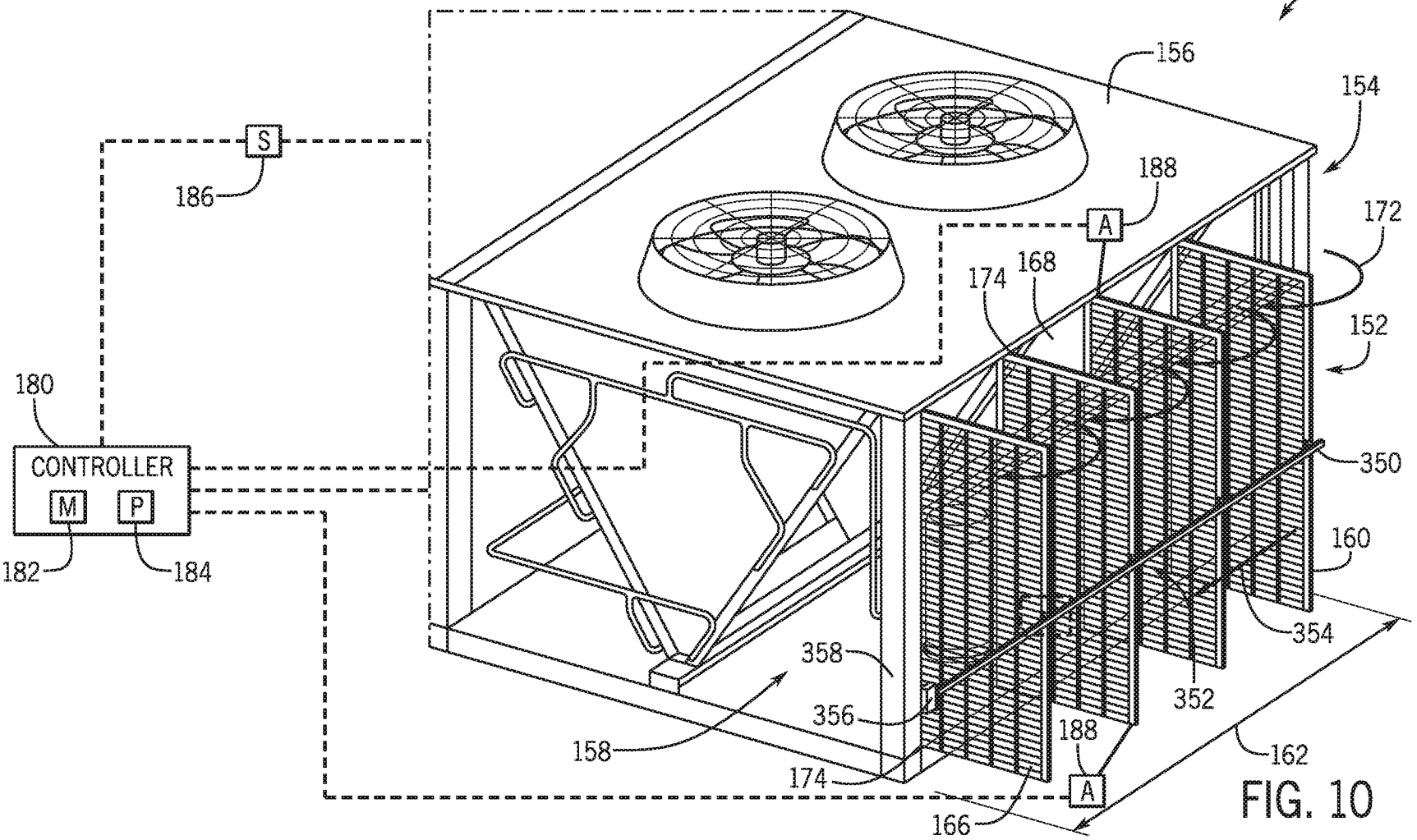
FIG. 10 is a perspective view of another embodiment of an HVAC system that includes an adjustable louver panel system with panels coupled together by a connector, in accordance with an aspect of the present disclosure.

A further embodiment of the louver panel system 152 is show in FIG. 10. FIG. 10 is a perspective view of an embodiment of the HVAC system 150 with a louver panel system 152 coupled to the housing 156 of the HVAC system 150. Similar to the louver panel system 152 illustrated in FIG. 5, the louver panel system 152 includes a plurality of louver panels 160 where each louver panel 160 is coupled to the housing 156 at the coupling points 174 to enable rotation of the louver panels 160 about the coupling points 174. Additionally, a connector 350 may extend along the length 162 of the side 154 of the HVAC system 150 and couple to each of the louver panels 160 via mounts 352. For example, the connector 250 may be a rod or bar. The connector 350 may be rotatably coupled to each louver panel 160 via the mounts 352. As such, actuation of the connector 350 enables joint rotational translation of the louver panels 160 about the mounts 352 as the louver panels 160 are translated between open and closed positions. For example, when the connector 350 moves in a direction 354, the connector 350 imparts a force onto the louver panels 160 to rotate the louver panels 160 in the direction 172. In this manner, each louver panel 160 is rotated in the direction 172 simultaneously such that all louver panels 160 are in the open position. As each louver panel 160 may be approximately the same size, the mounts 352 may be evenly spaced along the connector 350.

As with the louver panel system 152 of FIGS. 5-9, the louver panels 160 are configured to adjust between an open position and a closed position. In some embodiments, the louver panels 160 are in the closed position when the face 166 of each louver panel 160 is substantially parallel to the side 154, and each louver panel 160 covers a portion of the side 154 to protect the internal components 158 of the HVAC system 150 from external elements. Moreover, each louver panel 160 may interlock with adjacent louver panels 160 to cover the space 168 between adjacent louver panels 160. The louver panels 160 may adjust to the open position via rotation in the direction 172 to expose the internal components 158.

To set the position of the louver panels 160, the louver panels 160 may use the aforementioned components of the coupling points 174 and/or the mounts 352. For example, the coupling points 174 and/or the mounts 352 may have brackets, pins, latches, or other features to block rotation of the louver panels 160 relative to the connector 350 and/or the housing 156 and fix the position of the louver panels 160. Additionally, the connector 350 may include a handle 356 disposed at an end of the connector 350. The handle 356 may enable improved actuation of the connector 350 to transition the louver panel system 152 between the open and closed positions. For example, a user may grip the handle 356 and manually move the connector 350 in the direction 354 to rotate the louver panels 160 in the direction 172, thereby opening the louver panels 160 to expose the internal components 158. The user may also grip the handle 356 to move the connector 350 in a direction opposite the direction 354 to rotate the louver panels 160 in a direction opposite the direction 172, thereby closing the louver panels 160 and shrouding the internal components 158. Although FIG. 10 illustrates the connector 350 as including the handle 356 at one end of the connector 350, there may be a handle 356 or multiple handles 356 at each end of the connector 350 and/or another position along the connector 350. Each handle 356 may be of any suitable shape to enable gripping of the connector 350 by a user.

Although FIG. 10 depicts one connector 350 coupling the louver panels 160 together, it should be appreciated that there may be several connectors 350 coupled to the louver panels 160. In some embodiments, each connector 350 is coupled to all of the louver panels 160 via the mounts 352. In additional or alternative embodiments, a connector 350 may couple to a portion of the louver panels 160 while another connector 350 may couple to a remainder of the louver panels 160. In this manner, there may be several connectors 350 that couple all of the louver panels 160 together and any of the connectors 350 may move in the direction 354 to rotate the louver panel system 152. To securely couple the louver panels 160 together, the connector 350 may include a metal, an alloy, a composite, or any combination thereof. Furthermore, the connector 350 may be non-linear but still be suitably shaped to rotate the louver panel system 152.

In certain embodiments, the controller 180 is configured to translate the louver panel system 152 between the open position and the closed position. For example, the louver panel system 152 may include actuators 188 coupled to the mounts 352, the coupling points 174, or any combination thereof. The controller 180 may be configured to actuate rotation the components in similar methods described in FIG. 5 using the sensors 186 and the actuators 188.

Figure 11:
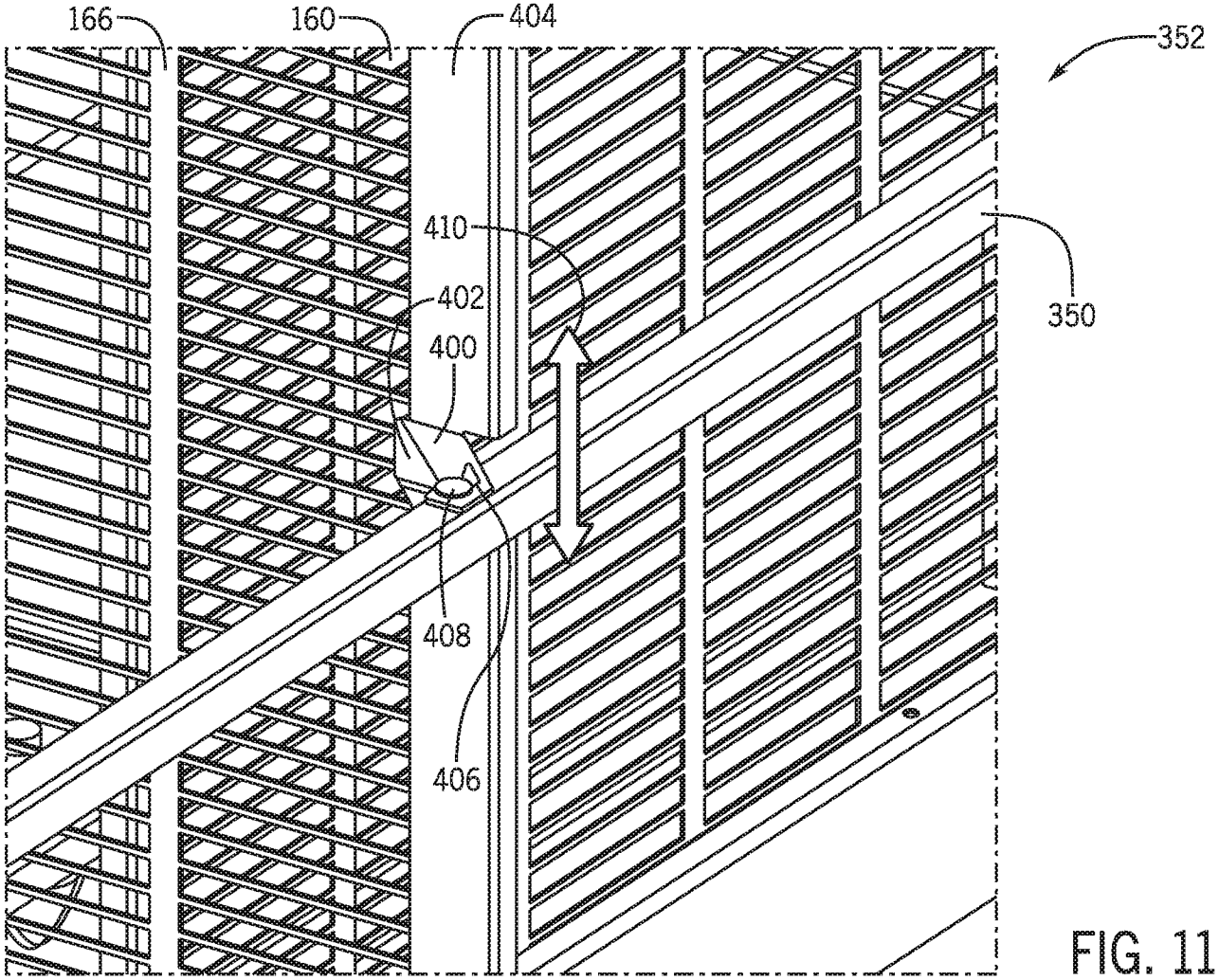
FIG. 11 is an expanded view of an embodiment of the adjustable louver panel system of FIG. 10, in accordance with an aspect of the present disclosure.

To further illustrate the coupling of the connector 350 with the louver panels 160, FIG. 11 is an expanded view of an embodiment of the mount 352. As shown in FIG. 11, the mount 352 includes a link 400 configured to couple the connector 350 to one of the louver panels 160. A first end 402 of the link 400 may be coupled to each louver panel 160, such as at a frame portion 404 extending about a perimeter of the louver panel 160. A second end 406 of the link 402 may be coupled to the connector 350. The link 400 enables rotary movement between the link 400 and the louver panel 160 as well as between the link 400 and the connector 350. Additionally, the link 400 may include a locking portion 408 disposed on the second end 406. The locking portion 408 may be configured to set the position of the connector 350 by blocking rotary movement of the link 402 relative to the connector 350 and/or the louver panel 160. In some embodiments, the locking portion 408 is a pin configured to move in vertical directions 410, such that the locking portion 408 inserts into and out of the connector 350. When the locking portion 408 is fully inserted in the connector 350, rotary movement between the connector 350 and the link 400 may be blocked. Blocking movement between the connector 350 and the link 400 may also block movement between the link 400 and the louver panels 160, thereby fixing or setting the position of the louver panel system 152.

The locking portion 408 may also include other components to set the position of the louver panel system 152, such as a clamp, a fastener, a latch, another component, or any combination thereof. The locking portion 408 may be disposed at any of the mounts 352 to lock the position of the louver panel system 152, and each locking portion 408 may be separate from one another. It should be appreciated that in certain embodiments, the locking portion 408 may be additionally or alternatively disposed at the first end 402 and may be configured to block rotational movement between the link 400 and the louver panels 160 to set the position of the louver panel system 152. Furthermore, the position of the locking portion 408 may be adjusted manually or via the controller 180 such that the position of the louver panel system 152 may be adjusted and/or set in different manners. To this end, the sensors 186 may be configured to determine the position of the panel 160, the connector 350, and/or the link 400 to determine when to actuate the locking portion 408.

Although FIGS. 5-10 illustrate the louver panel system 152 as positioned on the side 154 of the HVAC system 150, the louver panel system 152 may be positioned in additional sides or portions of the HVAC system 150 to protect the internal components 158 of the HVAC system 150. It should be appreciated that, for different sides of the HVAC system 150, embodiments of the louver panel system 152 may vary. For example, one side of the HVAC system 150 may include the embodiment of the louver panel system 152 of FIG. 5, while other sides of the HVAC system 150 may include the embodiment of the louver panel system 152 of FIG. 10. Additionally, while the position of the louver panel system 152 is adjusted, the HVAC system 150 may continue to operate. That is, the HVAC system 150 may continue conditioning operations while the louver panel system 152 is translating between the open position and the closed position.

As set forth above, embodiments of the present disclosure may provide one or more technical effects useful in the operation of HVAC systems. For example, an HVAC system includes a louver panel system configured to shroud internal components of the HVAC system from an ambient environment. The louver panel system may be configured to translate between a closed position and an open position. When in the closed position, louver panels of the louver panel system shroud the internal components and protect the internal components of the HVAC system from external elements of the ambient environment. The louver panels may include openings to enable airflow between the interior volume of the HVAC system 150 and the ambient environment. In the open position, the louver panels are actuated to expose the internal components of the HVAC system 150 to the ambient environment, thereby permitting a greater flow of air between the interior volume of the HVAC system 150 and the ambient environment, which may increase efficiency of the HVAC system in operation. The louver panels may be translated between the closed position and the open position via rotational translation and/or linear translation, which may be performed manually and/or via a controller. The controller may be configured to determine conditions of the ambient environment to determine whether the louver panels should be in the closed position to shroud the internal components or in the open position to permit greater airflow to the internal components. The controller may also be configured to adjust an amount that the louver panels are open and set or fix the position of each louver panel. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, mounting arrangements, use of materials, colors, orientations, and the like, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosed embodiments, or those unrelated to enabling the claimed embodiments. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A housing system for heating, ventilation, and/or air conditioning (HVAC) equipment, comprising:

a housing configured to shroud the HVAC equipment;

a plurality of louver panels disposed on the housing, wherein each louver panel of the plurality of louver panels is configured to translate between a closed position and an open position, wherein each louver panel of the plurality of louver panels is configured to permit airflow between an interior of the housing and an ambient environment enabling operation of the HVAC equipment when the louver panel is in the closed position, wherein each louver panel of the plurality of louver panels comprises a frame portion and a plurality of louver blades coupled to the frame portion at fixed positions relative to the frame portion, and wherein each louver panel of the plurality of louver panels is configured to permit increased airflow between the interior of the housing and the ambient environment when the louver panel is in the open position; and a rotational joint disposed between adjacent louver panels of the plurality of louver panels, wherein the adjacent louver panels are configured to rotationally translate about the rotational joint to translate between the closed position and the open position.

2. The housing system of claim 1, wherein each louver panel of the plurality of louver panels is coupled to a connector, and wherein actuation of the connector enables joint rotational translation of the plurality of louver panels between the open position and the closed position.

3. The housing system of claim 2, wherein the connector comprises a locking mechanism configured to set a position of the plurality of louver panels.

4. The housing system of claim 1, further comprising a controller configured to actuate translation of each louver panel of the plurality of louver panels.

5. The housing system of claim 1, further comprising:

an actuator configured to actuate translation of the plurality of louver panels between the closed position and the open position; and a controller configured to regulate operation of the actuator, wherein the controller is configured to regulate operation of the actuator based on a weather condition, a time of day, an atmospheric pressure, an ambient temperature, or any combination thereof.

6. A housing for heating, ventilation, and air conditioning (HVAC) equipment, comprising:

a frame defining an internal volume configured to receive the HVAC equipment;

a plurality of louver panels coupled to the frame, wherein each louver panel of the plurality of louver panels is configured to translate between a closed position and an open position, wherein each louver panel of the plurality of louver panels is configured to shroud the internal volume in the closed position and expose the internal volume in the open position, wherein a louver panel of the plurality of louver panels comprises a frame portion and a plurality of louver blades coupled to the frame portion at fixed positions relative to the frame portion, and wherein openings between the plurality of blades enable airflow between the internal volume and an ambient environment that enables operation of the HVAC equipment when the louver panel is in the closed position; and a connector coupled to each louver panel of the plurality of louver panels to enable joint translation of the plurality of louver panels between the closed position and the open position.

7. The housing of claim 6, wherein each louver panel of the plurality of louver panels is pivotably coupled to the frame to enable rotation of the plurality of louver panels between the closed position and the open position.

8. The housing of claim 6, wherein each louver panel of the plurality of louver panels is configured to linearly translate along the frame between the closed position and the open position.

9. The housing of claim 6, further comprising:

an actuator configured to actuate translation of the plurality of louver panels between the closed position and the open position; and a controller configured to regulate operation of the actuator.

10. The housing of claim 9, wherein the controller is configured to regulate operation of the actuator based on a weather condition, a time of day, an atmospheric pressure, an ambient temperature, or any combination thereof.

11. The housing of claim 6, wherein the plurality of louver panels is configured to form spaces between the plurality of louver panels in the open position to permit increased airflow between the internal volume and the ambient environment via the spaces.

12. An enclosure for heating, ventilation, and/or air conditioning (HVAC) equipment, comprising:

a housing configured to contain the HVAC equipment within an interior of the housing; and a louvered panel system coupled to the housing, wherein the louvered panel system comprises a plurality of louvered panels, wherein each louvered panel comprises a frame portion and a plurality of louvers coupled to the frame portion at fixed positions relative to the frame portion to form a plurality of openings between the plurality of louvers, wherein each louvered panel of the plurality of louvered panels is configured to linearly translate between an open position and a closed position, wherein each louvered panel is configured to permit airflow enabling operation of the HVAC equipment between the interior of the housing and an ambient environment via the plurality of openings when the louvered panel is in the closed position, wherein each louvered panel of the plurality of louvered panels is configured to permit increased airflow between the interior of the housing and the ambient environment via a space formed when the louvered panel is in the open position.

13. The enclosure of claim 12, wherein the housing comprises a plurality of sides, wherein the louvered panel system is coupled to a side of the plurality of sides.

14. The enclosure of claim 12, wherein the louvered panel system further comprises:

an actuator configured to translate the plurality of louvered panels between the open and closed positions; and a controller configured to regulate operation of the actuator based on received feedback.

15. The enclosure of claim 14, wherein the louvered panel system further comprises sensors, wherein the sensors are configured to monitor parameters associated with operating conditions of the HVAC equipment, and wherein the received feedback is based on the parameters.

16. The enclosure of claim 15, wherein the parameters comprise an amount of precipitation, an ambient temperature, an atmospheric pressure, a position of the plurality of louvered panels, a wind condition, a time of day, a time of year, or any combination thereof.

17. The enclosure of claim 12, wherein the plurality of louvered panels is configured to occupy the spaces when each louvered panel of the plurality of louvered panels is in the closed position.

* * * * *